US010443332B2

(12) United States Patent
Scott

(10) Patent No.: US 10,443,332 B2
(45) Date of Patent: Oct. 15, 2019

(54) DOWNHOLE TOOL WITH RETRIEVABLE ELECTRONICS

(71) Applicant: HALLIBURTON ENERGY SERVICES, INC., Houston, TX (US)

(72) Inventor: Bruce Edward Scott, Mckinney, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 65 days.

(21) Appl. No.: 14/890,481

(22) PCT Filed: Dec. 20, 2013

(86) PCT No.: PCT/US2013/077159

§ 371 (c)(1),
(2) Date: Nov. 11, 2015

(87) PCT Pub. No.: WO2015/094362

PCT Pub. Date: Jun. 25, 2015

(65) Prior Publication Data

US 2016/0108692 A1 Apr. 21, 2016

(51) Int. Cl.

| | |
|---|---|
| ***E21B 23/03*** | (2006.01) |
| ***E21B 23/14*** | (2006.01) |
| ***E21B 47/12*** | (2012.01) |

(52) U.S. Cl.
CPC ..... *E21B 23/14* (2013.01); *E21B 23/03* (2013.01); *E21B 47/124* (2013.01)

(58) Field of Classification Search
CPC ..... E21B 23/03; E21B 23/14; E21B 47/124
See application file for complete search history.

(56) References Cited

U.S. PATENT DOCUMENTS 3,665,955 A * 5/1972 Conner, Sr. ..... E21B 17/02 137/495
3,863,961 A * 2/1975 Dinning ..... E21B 23/03 166/215
3,939,705 A * 2/1976 Glotin ..... E21B 23/03 73/152.51

(Continued)

FOREIGN PATENT DOCUMENTS

EP 2642066 A1 * 9/2013 ..... E21B 23/03

OTHER PUBLICATIONS

International Preliminary Report on Patentability issued in related Application No. PCT/US2013/077159, dated Jun. 30, 2016 (11 pages).

(Continued)

*Primary Examiner* — Matthew R Buck
(74) *Attorney, Agent, or Firm* — Scott Richardson; Baker Botts L.L.P.

(57) ABSTRACT

Methods and apparatuses are disclosed for a downhole tool apparatus, that may include at least one pocket disposed within the downhole tool, which may include a tool electronic connection point; a latching mechanism; and a retrievable module; wherein the retrievable module may include: a module electrical connection point, wherein the tool electrical connection point and the module electrical connection point are electrically connected; a retrieving and running feature, wherein the module electrical connection point and the retrieving and running feature are on substantially opposite ends of the retrievable module; and wherein the latching mechanism engages the retrievable module to hold the retrievable module in the at least one pocket.

19 Claims, 5 Drawing Sheets

(56) References Cited

U.S. PATENT DOCUMENTS 4,026,363 A * 5/1977 Yonker ..... E21B 23/03 166/117.5
4,105,279 A * 8/1978 Glotin ..... E21B 17/028 166/117.5
RE29,870 E * 12/1978 Moore, Jr. ..... E21B 23/03 166/117.5
4,239,082 A * 12/1980 Terral ..... E21B 23/03 137/155
4,375,237 A * 3/1983 Churchman ..... E21B 23/03 166/117.5
4,440,222 A * 4/1984 Pullin ..... E21B 23/03 166/117.5
4,442,893 A * 4/1984 Foust ..... E21B 23/03 166/117.5
4,454,913 A * 6/1984 Guidry ..... E21B 23/03 166/117.5
4,480,686 A * 11/1984 Coussan ..... E21B 23/03 166/117.5
4,480,687 A * 11/1984 Terral ..... E21B 23/03 166/117.5
4,508,165 A * 4/1985 Foust ..... E21B 23/03 166/117.5
4,605,065 A * 8/1986 Abercrombie ..... E21B 23/03 166/117.5
4,846,269 A * 7/1989 Schnatzmeyer ..... E21B 17/003 166/117.5
5,455,573 A * 10/1995 Delatorre ..... E21B 17/028 166/250.11
5,457,988 A * 10/1995 Delatorre ..... E21B 17/01 340/854.6
5,740,860 A * 4/1998 Crawford ..... E21B 17/028 166/117.6
5,797,453 A * 8/1998 Hisaw ..... E21B 23/03 166/117.5
6,068,015 A * 5/2000 Pringle ..... E21B 43/123 137/155
6,230,812 B1 * 5/2001 Reaux ..... E21B 17/003 166/117.5
6,422,312 B1 * 7/2002 Delatorre ..... E21B 43/12 166/242.5
6,708,763 B2 * 3/2004 Howard ..... E21B 41/0078 166/222
6,845,817 B2 * 1/2005 Schraub ..... E21B 23/03 166/117.5
9,394,754 B2 * 7/2016 Kleppa ..... E21B 23/03
2004/0020643 A1 * 2/2004 Thomeer ..... E21B 47/01 166/250.01

OTHER PUBLICATIONS

International Search Report and Written Opinion issued in related PCT Application No. PCT/US2013/077159, dated Sep. 25, 2014 (14 pages).

* cited by examiner

DOWNHOLE TOOL WITH RETRIEVABLE ELECTRONICS

CROSS-REFERENCE TO RELATED APPLICATION

The present application is a U.S. National Stage Application of International Application No. PCT/US2013/077159 filed Dec. 20, 2013, which is incorporated herein by reference in its entirety for all purposes.

BACKGROUND

The present invention relates generally to tools used in an oilfield wellbore, and more specifically to electronic components for use in such tools.

Tools containing electrical components and/or requiring electrical power are often used in downhole operations in a wellbore. One way to provide power to the electrical components is through a battery pack. Typically, the battery pack is located in an annular housing mounted in the bore of a downhole tool. If an electronics component or battery pack used in the tool must be replaced, the tool often must be accessed and disassembled to retrieve or replace the electrical component or battery pack located inside.

Some downhole tools are designed to remain in the well permanently. Currently, when electronics are used in downhole tools, the electronic components are often the limiting factor in the life of the tool. If the electronic components fail, the only way to correct the problem is to retrieve the entire tool by pulling the tubing string, which can result in substantial costs. In addition, outside of failure or malfunction, one might desire to change the firmware, hardware, or any other number of features that are affected by the electronics.

Battery components also have a very limited life and create a limiting factor in the life of the tool. Similar to electronics, when a battery located in a permanently installed tool reaches the end of its life, the tool powered by the battery is no longer usable without replacement. In addition, battery powered tools are typically installed in the internal diameter of the tubing string, which takes up space and reduces space in the tubing string.

FIGURES

Some specific exemplary embodiments of the disclosure may be understood by referring, in part, to the following description and the accompanying drawings.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present invention relates generally to tools used in an oilfield wellbore, and more specifically to electronic components for use in such tools.

Illustrative embodiments of the present disclosure are described in detail herein. In the interest of clarity, not all features of an actual implementation may be described in this specification. It will of course be appreciated that in the development of any such actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

The terms "couple" or "couples" as used herein are intended to mean either an indirect or direct connection. Thus, if a first device couples to a second device, that connection may be through a direct connection, or through an indirect mechanical or electrical connection via other devices and connections. The term "uphole" as used herein means along the drillstring or the hole from the distal end towards the surface, and "downhole" as used herein means along the drillstring or the hole from the surface towards the distal end.

To facilitate a better understanding of the present disclosure, the following examples of certain embodiments are given. In no way should the following examples be read to limit, or define, the scope of the disclosure. Embodiments of the present disclosure may be applicable to horizontal, vertical, deviated, multilateral, u-tube connection, intersection, bypass (drill around a mid-depth stuck fish and back into the well below), or otherwise nonlinear wellbores in any type of subterranean formation. Embodiments may be applicable to injection wells, and production wells, including natural resource production wells such as hydrogen sulfide, hydrocarbons or geothermal wells; as well as borehole construction for river crossing tunneling and other such tunneling boreholes for near surface construction purposes or borehole u-tube pipelines used for the transportation of fluids such as hydrocarbons. Embodiments described below with respect to one implementation are not intended to be limiting.

Figure 1:
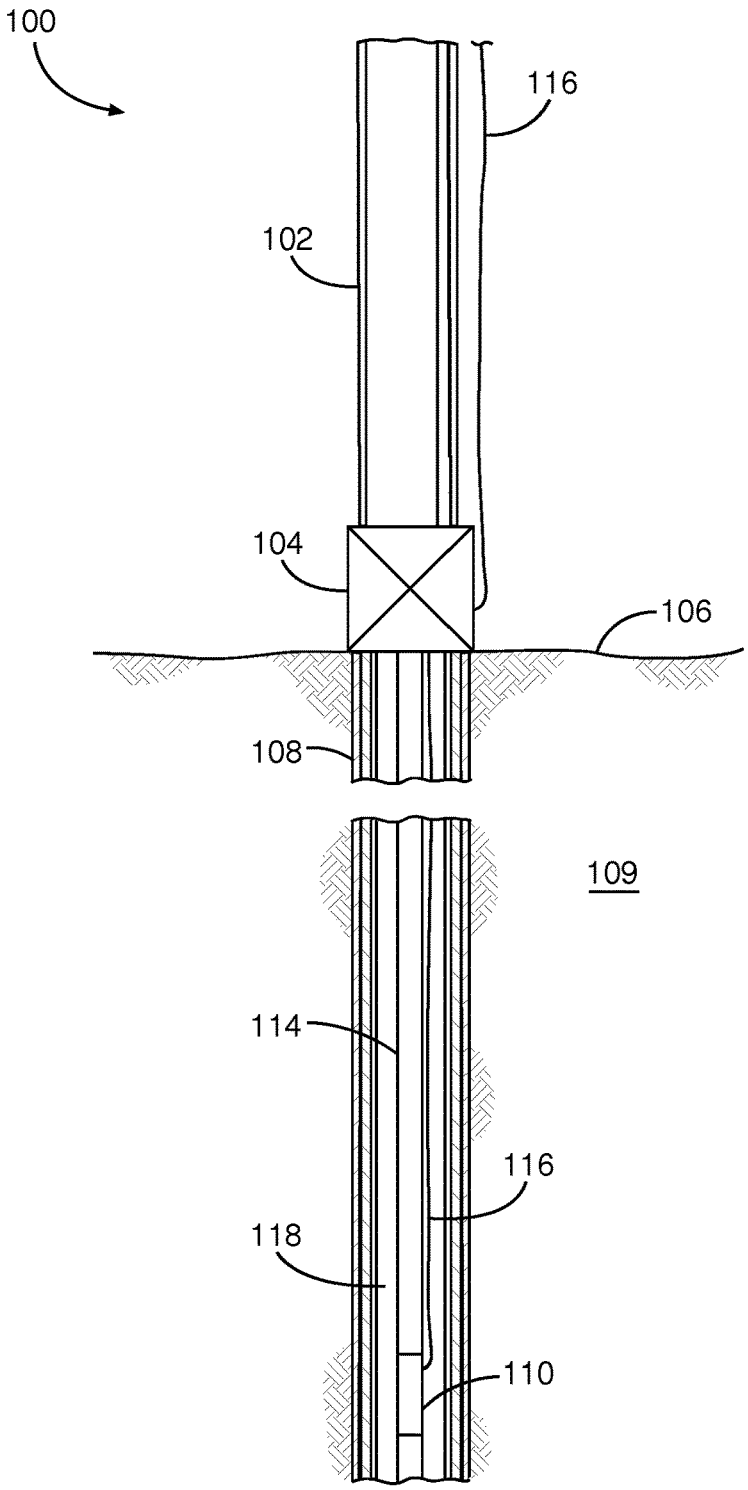
FIG. 1 illustrates an example well system that incorporates one or more principles of the present disclosure, according to aspects of the present disclosure.

Referring now to FIG. 1, illustrated is a well system 100 that incorporates one or more aspects of an exemplary downhole tool 110, according to the present disclosure. As illustrated by example, the well system 100 may comprise a rise 102 extending from a wellhead installation 104 arranged at a seafloor 106. The riser 102 may extend, for example, to an offshore oil and gas platform through an earth formation 109. The wellbore 108 is depicted as being cased, but the wellbore 108 may be uncased without departing from the scope of the disclosure. Although FIG. 1 depicts the well system 100 in the context of an offshore oil and gas application, it will be appreciated by those skilled in the art that the various embodiments disclosed herein are equally well suited for use in or on other types of oil and gas rigs, such as land-based oil and gas rigs or rigs located at any other geographical site. Thus, it should be understood that the disclosure is not limited to any particular type of well.

The well system 100 may further comprise a downhole tool 110 interconnected with a tubing string 114 arranged within the wellbore 108 and extending from the wellhead installation 104. The tubing string 114 may allow the communication of fluids derived from the wellbore 108 to the well surface via the wellhead installation 104. In certain embodiments, an electric line 116 may extend from the well surface and into the wellhead installation 104, which, in turn, conveys the electric line 116 into an annulus 118 defined between the wellbore 108 and the tubing string 114. The electric line 116 may extend downward within the annulus 118 to be eventually electrically coupled to the downhole tool 110. In certain embodiments, a plurality of electric lines may extend to the downhole tool 110. The downhole tool 110 may comprise any electrically powered tool for use downhole within a wellbore, such as, for example, a subsurface safety valve, downhole flow meter, sliding side door, interval control valve, circulating valve, or any tool that may require an electronics component.

Figure 2:
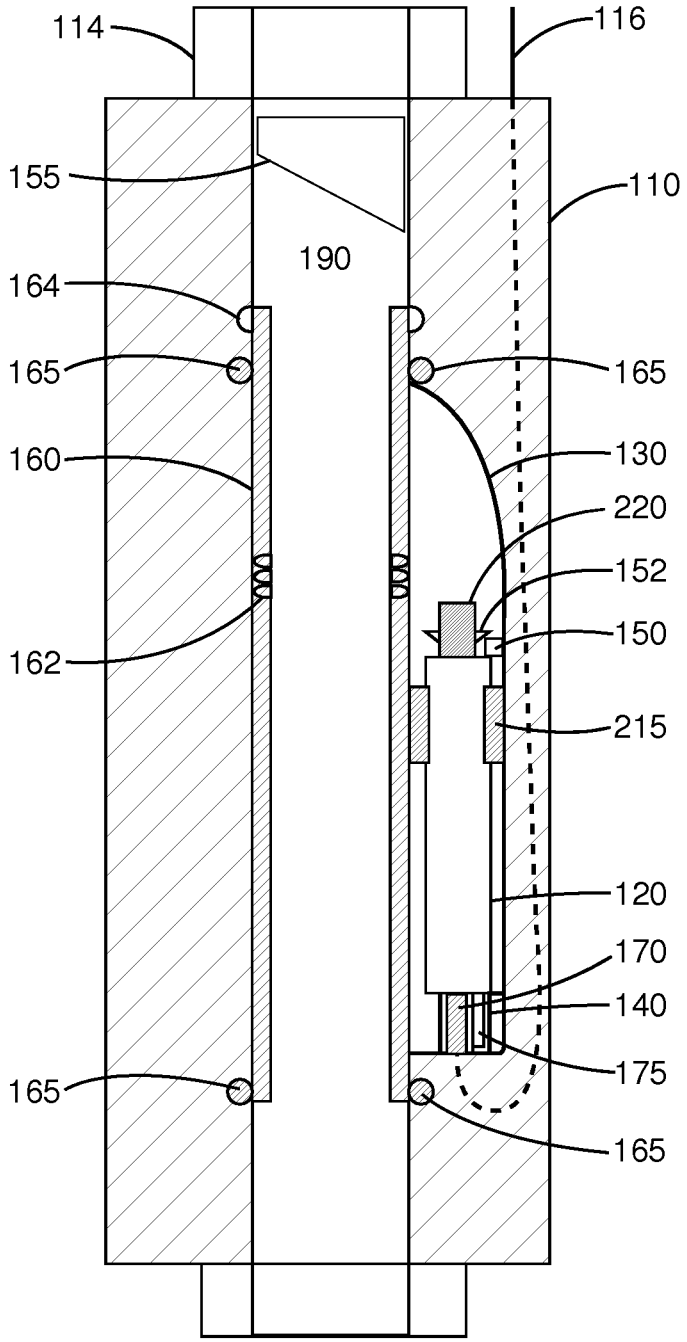
FIG. 2 illustrates an example downhole tool with retrievable electronics that incorporates one or more principles of the present disclosure, according to aspects of the present disclosure.

Referring now to FIG. 2, a cross-section of the downhole tool 110 is shown connected to a portion of the tubing string 114. The downhole tool 110 may have a retrievable module 120 located in a pocket 130 within the downhole tool 110. The retrievable module 120 may comprise any component that the operator desires to make retrievable and/or replaceable without pulling the downhole tool 110 to the surface. In certain embodiments, the retrievable module 120 may comprise an electronics package. In certain embodiments, the retrievable module 120 may comprise a battery package. The pocket 130 may be disposed within the body of the downhole tool 110 and may be configured to receive the retrievable module 120.

The pocket 130 may comprise a tool electrical connection point 140. The tool electrical connection point 140 may be configured to mate with a module electrical connection point 170 located on the retrievable module 120 to create an electrical connection between the retrievable module 120 and the downhole tool 110 via the tool electrical connection point 140. In certain embodiments, the tool electric connection point 140 and the module electrical connection point 170 may create a wet mateable electric connection. The module electrical connection point 170 may comprise a female connection point or a male connection point. As such, the tool electrical connection point 140 may comprise a female connection point or a male connection point to engage the module electrical connection point 170. The tool electrical connection point 140 and the module electrical connection point 170 may each comprise a single pin connection point, a multi-pin connection point, or a concentric multi-conductor connector.

In certain embodiments, the pocket 130 may comprise a latching mechanism 150. The latching mechanism 150 may engage a module latching feature 152 disposed on the retrievable module 120 opposite the module electrical connection point 170. In certain embodiments, the latching feature 152 may comprise a wire-retrievable gas lift valve latch. The latching mechanism may engage the retrievable module 120 while in the pocket 130 to keep the module electrical connection point 170 in electrical connection with the tool electrical connection point 140.

In certain embodiments, the downhole tool 110 may be powered by an electrical line 116 from the surface. The electrical line 116 may be electrically connected to the retrievable module 120 via the tool electrical connection point 140 and the module connection point 170 to supply power to the retrievable module 120.

The downhole tool 110 may comprise any tool used downhole in a wellbore, including, but not limited to, an electric subsurface safety valve, downhole flow meter, sliding side door, interval control valve, circulating valve, or any other downhole tool that uses an electronic or battery component. The downhole tool 110 may be a standalone tool or a sub attached to one or more separate tools.

In certain embodiments, the pocket 130 may comprise a guide (not shown) to orient the retrievable module 120 during installation, for example, to facilitate creating the electrical connection with a multi-pin electrical connection point 140. In certain embodiments, the guide may be an orienting sleeve as described with respect to FIGS. 4A and 4B, herein. The orienting sleeve may be placed so as to orient the module electrical connection point 170 into a position compatible with the module electrical connection point 140 to facilitate establishing an electrical connection as it translates downward.

Figure 3A:
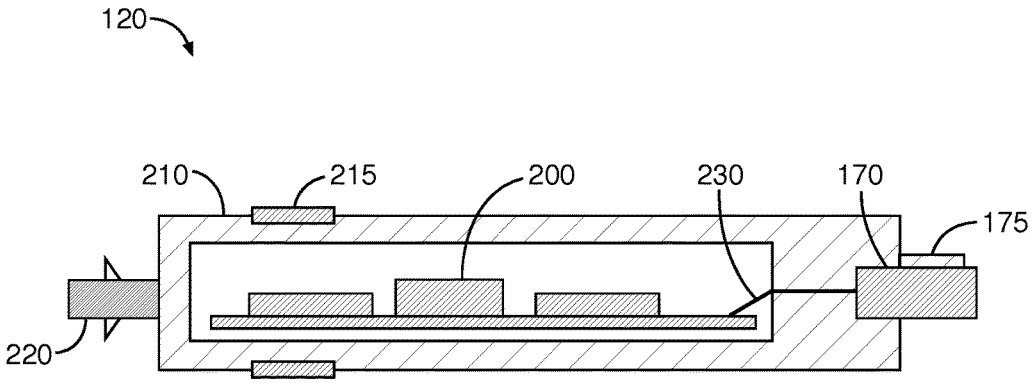
FIG. 3A illustrates an example retrievable module for use in a downhole tool comprising an electronics package, according to aspects of the present disclosure

Referring now to FIG. 3A, a retrievable module 120 is shown comprising an electronics package 200. The retrievable module 120 may comprise a body 210, a retrieving and running feature 220, and a module electrical connection point 170. In certain embodiments, the retrieving and running member 220 may comprise a fish neck. The electronics package 200 may be enclosed by the body 210. In certain embodiments, the body 210 may comprise a centralizing feature 215 to substantially maintain the position of the retrievable module within the pocket. In certain embodiments, the centralizing feature 215 may comprise, for example, one or more guide rings, seals (such as, o-rings or v-rings), or any other member that may be used to maintain the lateral position of the retrievable module within the pocket. The electronics package 200 may be electrically connected to the module electrical connection point 170 using an electrical conduit 230. In certain embodiments, the module electrical connection point 170 may comprise the connection orienting key 175, as described above.

Figure 3B:
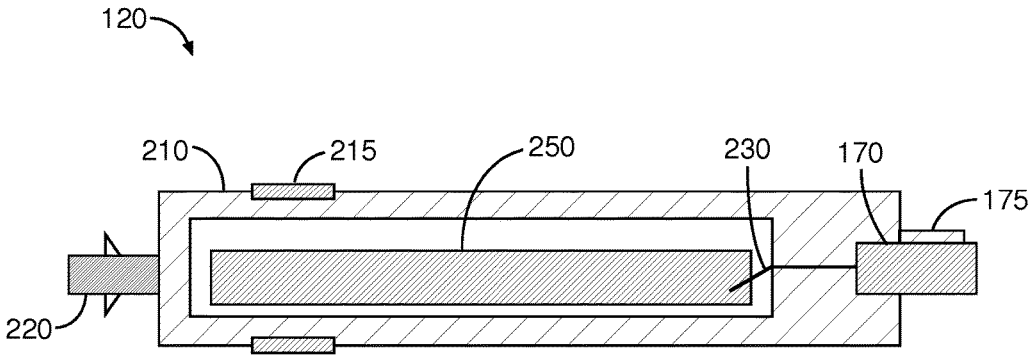
FIG. 3B illustrates an example retrievable module for use in a downhole tool comprising a battery package, according to aspects of the present disclosure.

Referring now to FIG. 3B, a retrievable module 120 is shown comprising a battery package 250. The retrievable module 120 may comprise a body 210, a retrieving and running member 220, and a module electrical connection point 170. The battery package 250 may be enclosed by the body 210. The battery package 200 may be electrically connected to the module electrical connection point 170 using an electrical conduit 230.

In certain embodiments, the downhole tool may comprise a plurality of pockets, each configured to accept a retrievable module 120. As such, the downhole tool may comprise a plurality of retrievable modules 120.

Figure 4A:
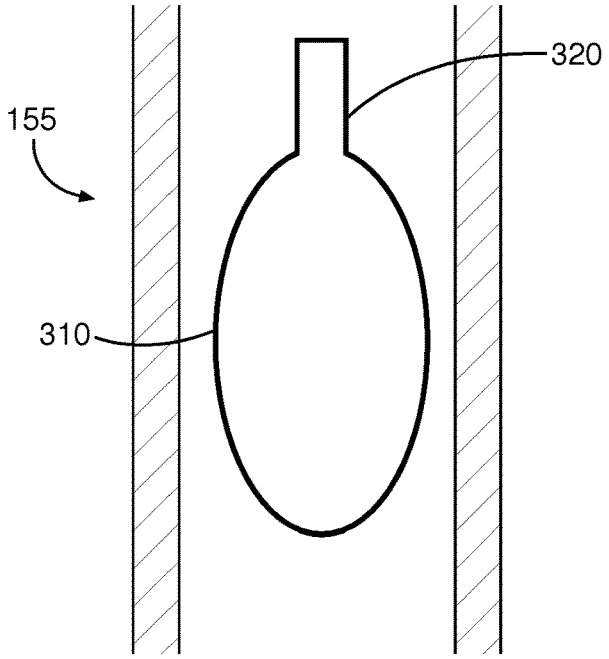
FIG. 4A is a front-view illustration of an example orienting feature, according to aspects of the present disclosure.
Figure 4B:
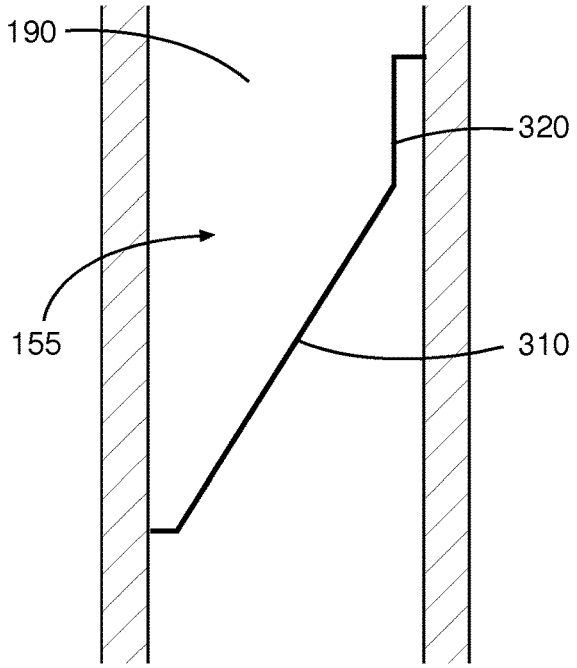
FIG. 4B is a side-view illustration of an example orienting feature, according to aspects of the present disclosure.

Referring briefly back to FIG. 2, in certain embodiments, the downhole tool 110 may comprise a locating mechanism 155 to orient a kick-over tool used for retrieving and/or docking the proper retrievable module 120 to the correct electrical connection point 140. In certain embodiments, the locating mechanism 155 may be disposed within a tool inner diameter 190. FIGS. 4A and 4B show a front-view and a side-view, respectively, of an example locating mechanism 155. To orient the kick-over tool, the retrievable module 120 may be passed through an orientation sleeve 310 of the locating mechanism 155 and pulled back up through the orientation sleeve 310. A key in the kick-over tool may be guided by the orientation sleeve into a slotted portion 320 to move the kick-over tool into the correct position to retrieve the retrievable module already located in the pocket or insert the retrievable module into the pocket. Once the kick-over tool is oriented with the pocket, moving the kick-over tool downward may insert the retrievable module into the pocket while pulling the kick-over tool upward may retrieve a retrievable module located within the pocket.

Figure 5A:
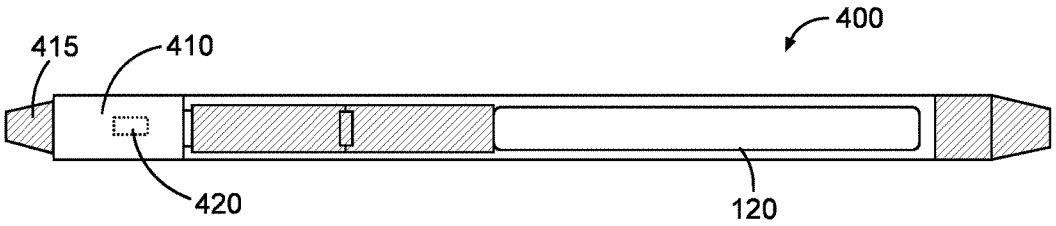
FIG. 5A is a side-view illustration of an example kick-out tool for running and/or pulling the retrievable module, according to aspects of the present disclosure.
Figure 5B:
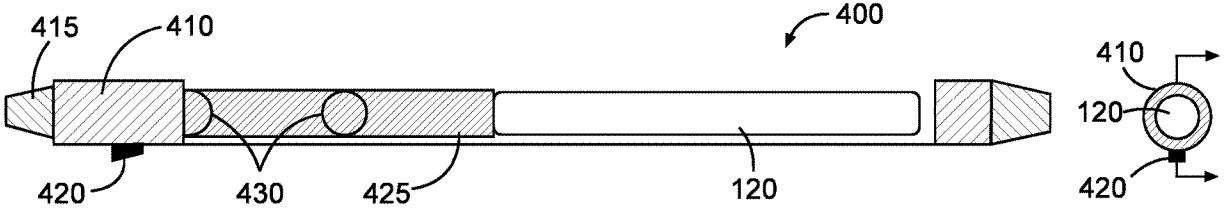
FIG. 5B is a top-view illustration of an example kick-out tool for running and/or pulling the retrievable module, according to aspects of the present disclosure.

FIG. 5A, shows a side view of an example kick-over tool 400 and FIG. 5B shows a front cross-sectional view of an example kick-over tool 400, according to aspects of the present disclosure. The kick-over tool 400 may comprise a fish neck 415 to allow the kick-over tool 400 to be run downward or pulled upward from the surface. The kick-over tool 400 may comprise a body 410 and an orienting key 420 attached to the body 410 to engage the orientation sleeve and rotate the kick-over tool 400 into the correct position. A latching member 425 may be connected to the body 410 via at least one pivot 430. The latching member 425 may be connected to a retrievable module 120. The retrievable module 120, latching member 425, and at least one pivot 430 may be contained within a chamber disposed within the body 410. In certain embodiments, as the orienting key 420 engages the orientation sleeve 310, the orienting key 420 may cause the body 410 to rotate such that the pocket is opposite, or 180 degrees, from the orienting key 420. In certain embodiments, the kick-over tool 400 may be oriented to interact with a pocket 180 degrees from the slotted portion 320.

Figure 5C:
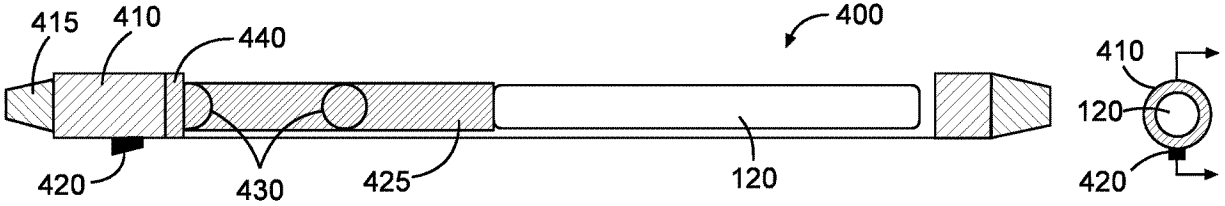
FIG. 5C is a top-view illustration of an example kick-out tool for running and/or pulling the retrievable module, comprising a rotation feature, according to aspects of the present disclosure.

In certain embodiments, as shown by a front cross-sectional view in FIG. 5C, the kick-over tool 400 may comprise a body rotation feature 440 connecting the body 410 to the at least one pivot and latching member 425. Once the kick-over tool 400 is oriented into the correct position, the body rotation feature 440 may allow the latching member and retrievable module 120 to kick-off to the appropriate angle relative to the oriented kick-off tool. This may allow the operator to set the kick-over tool 400 to engage the desired pocket in an embodiment with a plurality of pockets. For example, the at least one pivot 430 may be rotated 90 degrees relative to the orienting key 420 to allow the at least one pivot 430 to kick-off the retrievable package 120 toward the pocket at 90 degrees from the orienting sleeve. The kick-over tool 400 may be used to install the retrievable module 120 in the selected pocket by disengaging the latching member 425 after the retrievable module 120 is connected to the wet mate-able connection in the pocket. The kick-over tool 400 may also be used to remove the retrievable module 120 from the selected pocket by engaging the retrievable member running member with the latching mechanism 425 and pulling the retrievable module 120 out of the pocket.

Referring back to FIG. 1, in certain embodiments, the downhole tool 110 may comprise a protective sleeve 160 located between the pocket 130 and the tool inner diameter 190. The protective sleeve 160 may comprise at least one seal 165 to further isolate the pocket 130 from the inner diameter of the drill string 105. The protective sleeve 160 may substantially separate the pocket 130 and the retrievable module 120 located inside the pocket 130 from a fluid located in the tool inner diameter 190. In certain embodiments, the protective sleeve 160 may comprise a holding feature 164, such as, for example, a collet, to hold the protective sleeve 160 in place. In certain embodiments, the protective sleeve 160 may comprise a shifting profile 162 to allow a tool to engage the protective sleeve 160 and shift the protective sleeve to expose the pocket 130.

In certain embodiments, a method of retrieving a retrievable module, may comprise orienting a kick-over tool with at least one pocket disclosed within a downhole tool; engaging a retrievable module located within the at least one pocket with the kick-over tool; and translating the kick-over tool upwards to remove the retrievable module from the at least one pocket.

In certain embodiments, a method of installing a retrievable module, may comprise engaging a retrievable module with a kick-over tool; running the kick-over tool downward toward a downhole tool; orienting the kick-over tool with at least one pocket disclosed within the downhole tool; translating the kick-over tool downward to move the retrievable module into the at least one pocket; and electrically connecting a module electrical connection point disposed on the retrievable module and a tool electrical connection point disposed within the at least one pocket.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces.

What is claimed is:

1. A downhole tool apparatus, comprising:

at least one pocket disposed within the downhole tool, comprising:

a tool electrical connection point;

a latching mechanism;

a retrievable module, wherein the retrievable module engages the latching mechanism; and an orienting sleeve, wherein the orienting sleeve is engaged by an orienting key attached to the retrievable module;

a locating mechanism, wherein the locating mechanism comprises an orientation sleeve, wherein the retrievable module passes through the orientation sleeve and is pulled back up through the orientation sleeve to orient a kick-over tool, and wherein the orientation sleeve guides a key of the kick-over tool into a slotted portion of the locating mechanism;

wherein a latching member of the kick-over tool connects to a body rotation feature of the kick-over tool to allow the latching member and the retrievable module to kick-off to an angle relative to the downhole tool;

wherein the retrievable module comprises:

a module electrical connection point, wherein the tool electrical connection point and the module electrical connection point are electrically connected, wherein the latching mechanism keeps the tool electrical connection point in electrical connection with the module electrical connection point;

a retrieving and running feature, wherein the module electrical connection point and the retrieving and running feature are on substantially opposite ends of the retrievable module, wherein the orienting sleeve orients the module electrical connection point via the orienting key into a position compatible with the tool electrical connection point, wherein the kick-over tool is used to remove the retrievable module from the at least one pocket by engaging the retrieving and running feature with the latching member;

a body that encapsulates an electronics package, wherein the electronics package is electrically connected to the module electrical connection point using an electrical conduit; and wherein the latching mechanism engages a module latching feature of the retrievable module opposite the module electrical connection point to hold the retrievable module in the at least one pocket, and wherein the retrievable module is passed through the orientation sleeve and the orienting sleeve during installation.

2. The apparatus of claim 1, wherein the retrievable module comprises the body and a battery package, wherein the body encapsulates the battery package and the battery package is electrically connected to the module electrical connection point.

3. The apparatus of claim 1, wherein the locating mechanism is disposed within an inner diameter of the downhole tool.

4. The apparatus of claim 1, further comprising a protective sleeve disposed between the at least one pocket and a tool inner diameter and substantially separating the at least one pocket from the tool inner diameter.

5. The apparatus of claim 4, wherein the protective sleeve further comprises at least one seal.

6. The apparatus of claim 1, wherein the retrievable module further comprises a centralizing feature that engages the at least one pocket to maintain the position of the retrievable module within the pocket.

7. The apparatus of claim 1, wherein the tool electrical connection point is electrically connected to the surface via an electric line.

8. The apparatus of claim 1, wherein the module electrical connection point and the tool electrical connection point create a wet mate-able connection.

9. The apparatus of claim 1, wherein the downhole tool is a subsurface safety valve.

10. A method of orienting and retrieving a retrievable module, comprising:

orienting a kick-over tool with at least one pocket disposed within a downhole tool, wherein the at least one pocket comprises a tool electrical connection point, a latching mechanism, a retrievable module, and an orienting sleeve, wherein the orienting sleeve is engaged by an orienting key attached to the retrievable module:

wherein orienting the kick-over tool comprises:

passing the retrievable module through an orientation sleeve of a locating mechanism of the downhole tool;

guiding, by the orientation sleeve, a key of the kick-over tool into a slotted portion of the locating mechanism;

engaging the retrievable module located within the at least one pocket with the latching mechanism, wherein the latching mechanism engages a module latching feature disposed on the retrievable module opposite a module electrical connection point to hold the retrievable module in the at least one pocket, wherein the orienting sleeve orients the module electrical connection point disposed on the retrievable module via the orienting key into a position to electrically connect with the tool electrical connection point disposed within the at least one pocket, wherein a latching member of the kick-over tool connects to a body rotation feature of the kick-over tool that allows the latching member and the retrievable module to kick-off to the appropriate angle relative to the downhole tool;

translating the kick-over tool upwards to remove the retrievable module from the at least one pocket;

passing the retrievable module through the orientation sleeve of the locating mechanism of the downhole tool the orienting sleeve during installation; and pulling the retrievable module back up through the orienting sleeve and the orientation sleeve during retrieval of the retrievable module.

11. The method of claim 10, wherein orienting the kick-over tool comprises:

translating the kick-over tool upwards and towards the locating mechanism disposed within an inner diameter of the downhole tool;

engaging the orientation sleeve with the key;

translating the kick-over tool upwards until the key moves into the slotted portion, wherein the slotted portion is located 180 degrees from the at least one pocket.

12. The method of claim 10, wherein the retrievable module comprises a body and an electronics package, wherein the body encapsulates the electronics package and the electronics package is electrically connected to the module electrical connection point.

13. The method of claim 10, wherein the retrievable module comprises a body and a battery package, wherein the body encapsulates the battery package and the battery package is electrically connected to the module electrical connection point.

14. The method of claim 10, wherein the downhole tool is a subsurface safety valve.

15. A method of installing a retrievable module, comprising:

engaging the retrievable module with a kick-over tool;

running the kick-over tool downward toward a downhole tool;

orienting the kick-over tool with at least one pocket disposed within the downhole tool, wherein the at least one pocket comprises a tool electrical connection point, a latching mechanism, the retrievable module and an orienting sleeve, wherein the orienting sleeve is engaged by an orienting key attached to the retrievable module;

wherein orienting the kick-over tool comprises:

passing the retrievable module through an orientation sleeve of a locating mechanism of the downhole tool and pulling the retrievable module back up through the orientation sleeve;

guiding, by the orientation sleeve, a key of the kick-over tool into a slotted portion of the locating mechanism;

translating the kick-over tool downward to move the retrievable module into the at least one pocket using a body rotation feature of the kick-over tool that allows a latching member of the kick-over tool and the retrievable module to kick-off to an angle relative to the downhole tool; and electrically connecting a module electrical connection point disposed on the retrievable module and the tool electrical connection point, wherein the orientation sleeve of the locating mechanism orients the kick-over tool by guiding the key of the kick-over tool into the slotted portion of the locating mechanism, to move the kick-over tool to retrieve the retrievable module, wherein the orienting sleeve orients the module electrical connection point via the orienting key into a position compatible with the tool electrical connection point, wherein the retrievable module is passed through the orientation sleeve and the orienting sleeve during installation, wherein the retrievable module comprises an electronics package that is electrically connected to the module electrical connection point by an electrical conduit.

16. The method of claim 15, wherein orienting the kick-over tool comprises:

translating the kick-over tool upwards and towards the locating mechanism disposed within an inner diameter of the downhole tool;

engaging the orientation sleeve with the key; and translating the kick-over tool upwards until the key moves into the slotted portion, wherein the slotted portion is located 180 degrees from the at least one pocket.

17. The method of claim 15, wherein the retrievable module comprises a body, wherein the body encapsulates the electronics package and the electronics package is electrically connected to the module electrical connection point.

18. The method of claim 15, wherein the retrievable module comprises a body and a battery package, wherein the body encapsulates the battery package and the battery package is electrically connected to the module electrical connection point.

19. The method of claim 15, wherein electrically connecting the module electrical connection point and the tool electrical connection point further comprises creating a wet mate-able electric connection.

* * * * *